US009768545B1

(12) United States Patent
Hsu et al.

(10) Patent No.: US 9,768,545 B1
(45) Date of Patent: Sep. 19, 2017

(54) WATERPROOF CONNECTOR

(71) Applicant: Cheng Uei Precision Industry Co., Ltd., New Taipei (TW)

(72) Inventors: Li Nien Hsu, New Taipei (TW); Chih Lin Yang, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/498,467

(22) Filed: Apr. 26, 2017

Related U.S. Application Data

(63) Continuation-in-part of application No. 15/293,249, filed on Oct. 13, 2016, now Pat. No. 9,685,740.

(51) Int. Cl.
*H01R 13/52* (2006.01)
*H01R 13/6581* (2011.01)
*H01R 13/6585* (2011.01)

(52) U.S. Cl.
CPC ..... *H01R 13/521* (2013.01); *H01R 13/6581* (2013.01); *H01R 13/6585* (2013.01)

(58) Field of Classification Search
CPC ..... H01R 13/6585; H01R 13/6581; H01R 13/6594; H01R 13/521; H01R 13/5219; H05K 9/0088; H05K 7/1401
USPC .. 439/79, 271, 276, 607.05, 607.35, 607.28, 439/660
See application file for complete search history.

(56) References Cited

U.S. PATENT DOCUMENTS

| | | | | |
|---|---|---|---|---|
| 9,425,558 | B1 * | 8/2016 | Hsu | H01R 12/724 |
| 9,455,535 | B1 * | 9/2016 | Chiang | H01R 13/6585 |
| 9,525,243 | B1 * | 12/2016 | Yuan | H01R 13/6585 |
| 9,525,244 | B1 * | 12/2016 | Hsu | H01R 13/6585 |
| 9,590,364 | B1 * | 3/2017 | Chang | H01R 13/6581 |

* cited by examiner

*Primary Examiner* — Khiem Nguyen
(74) *Attorney, Agent, or Firm* — Cheng-Ju Chiang

(57) ABSTRACT

A waterproof connector includes an upper terminal module, a shielding plate, a lower terminal module, a dielectric element, a shielding shell and an insulating housing. The shielding plate is mounted under the upper terminal module. The lower terminal module is mounted under the shielding plate. The dielectric element is integrally molded outside the upper terminal module, the shielding plate and the lower terminal module. The shielding shell surrounds the dielectric element together with the upper terminal module, the shielding plate and the lower terminal module. The insulating housing is integrally molded outside the shielding shell together with the upper terminal module, the shielding plate, the lower terminal module and the dielectric element. The insulating housing has a rear board. A bottom surface of the rear board is recessed inward to form a receiving space. The rear board opens a guiding hole extending forward to the receiving space.

11 Claims, 15 Drawing Sheets

WATERPROOF CONNECTOR

This is a continuation-in-part (CIP) application of patent application Ser. No. 15/293,249, "Waterproof Connector", filed on Oct. 13, 2016.

BACKGROUND OF THE INVENTION

1. Field of the Invention

The present invention generally relates to a connector, and more particularly to a waterproof connector.

2. The Related Art

Usually, a conventional waterproof connector generally includes an upper terminal module, a shielding plate, a lower terminal module, a shielding shell and an insulating housing. The upper terminal module includes an upper body and a plurality of upper terminals. The upper body is integrally molded outside the upper terminals. The lower terminal module includes a lower body and a plurality of lower terminals. The lower body is integrally molded outside the lower terminals. The upper terminal module, the shielding plate and the lower terminal module are arranged and assembled vertically. The shielding shell surrounds the upper terminal module, the shielding plate and the lower terminal module. The insulating housing is integrally molded to the upper terminal module, the shielding plate, the lower terminal module and the shielding shell.

However, a clearance is formed among the upper terminal module, the shielding plate and the lower terminal module that makes water easily seep into the conventional waterproof connector. As a result, the conventional waterproof connector has a worse waterproof performance.

Thus, whether the above-mentioned problem is solved by virtue of designing an innovative waterproof connector has become an important issue which is to be solved by skilled persons in the art, so the innovative waterproof connector having a reasonable design and effectively improving the above-mentioned problem is essential to be provided.

SUMMARY OF THE INVENTION

An object of the present invention is to provide a waterproof connector. The waterproof connector includes an upper terminal module, a shielding plate, a lower terminal module, a dielectric element, a shielding shell, an insulating housing and a filling body. The upper terminal module includes an upper body and a plurality of upper terminals. The upper body is integrally molded outside the upper terminals. The upper terminals are arranged transversely. Top surfaces of front ends of the upper terminals are exposed to a top of the upper body. Tail ends of the upper terminals are exposed out of the upper body. A middle of a bottom surface of the upper body protrudes downward to form a protruding block. A middle of the protruding block is recessed inward to form a buckling groove. The shielding plate is mounted under the upper terminal module. A middle of the shielding plate opens an opening corresponding to the protruding block. The protruding block is locked in the opening. The lower terminal module mounted under the shielding plate, includes a lower body and a plurality of lower terminals. The lower body is integrally molded outside the lower terminals. The lower terminals are arranged transversely. Bottom surfaces of front ends of the lower terminals are exposed to a bottom of the lower body. Tail ends of the lower terminals are exposed out of the lower body. A middle of a top surface of the lower body protrudes upward to form a buckling block corresponding to the buckling groove. The buckling block is buckled in the buckling groove. The dielectric element is integrally molded outside the upper terminal module, the shielding plate and the lower terminal module. A front end of the shielding plate projects beyond a front surface of the dielectric element. A rear end of a bottom surface of the dielectric element is recessed inward to form a lacking groove. A top wall of the lacking groove is defined as an extending board. The tail ends of the upper terminals and the tail ends of the lower terminals project beyond a bottom surface of the extending board and are located in the lacking groove. The shielding shell surrounds the dielectric element together with the upper terminal module, the shielding plate and the lower terminal module. The insulating housing is integrally molded outside the shielding shell together with the upper terminal module, the shielding plate, the lower terminal module and the dielectric element. The insulating housing has a top board, a bottom board, a rear board and two side boards. An accommodating space is formed among the top board, the bottom board, the rear board and the two side boards. The upper terminal module, the shielding plate, the lower terminal module, the dielectric element and the shielding shell are accommodated in the accommodating space. A bottom surface of the rear board is recessed inward to form a receiving space. The extending board, the tail ends of the upper terminals and the tail ends of the lower terminals are received in the receiving space. The rear board opens a guiding hole penetrating rearward through a rear surface of the rear board and extending forward to the receiving space. The guiding hole is communicated with the receiving space. The bottom surface of the extending board is flush with a bottom surface of a top wall of the guiding hole. A space occupied by the tail ends of the upper terminals and a space occupied by the tail ends of the lower terminals are located between two facing surfaces of two side walls of the guiding hole.

As described above, the upper body is integrally molded outside the upper terminals, the lower body is integrally molded outside the lower terminals, the shielding plate is clamped between the upper body and the lower body by virtue of the upper body being buckled with the lower body, the dielectric element is integrally molded outside the upper terminal module, the shielding plate and the lower terminal module to seal up a clearance among the upper terminal module, the lower terminal module and the shielding plate, the shielding shell surrounds the dielectric element together with the upper terminal module, the shielding plate and the lower terminal module, the insulating housing is integrally molded outside the shielding shell together with the upper terminal module, the shielding plate, the lower terminal module and the dielectric element to seal up a clearance among the shielding shell, the upper terminal module, the shielding plate, the lower terminal module and the dielectric element, so that water hardly seeps into the waterproof connector by virtue of the waterproof connector adopting multiple integrative molding procedures to surround the upper terminals, the shielding plate, the lower terminals and the shielding shell therein. Furthermore, the filling body is filled in the receiving space, the guiding hole and at least one fastening hole of the insulating housing, and the filling body flows from the receiving space to the guiding hole and the at least one fastening hole, so that the filling body is capable of completely sealing up an interstice between upper portions of each two adjacent tail ends of the upper terminals and the lower terminals, and the joints among the extending board, the insulating housing, the upper terminal module, the shielding plate, the lower terminal module and the shielding shell. As a result, the waterproof connector has a better waterproof performance.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
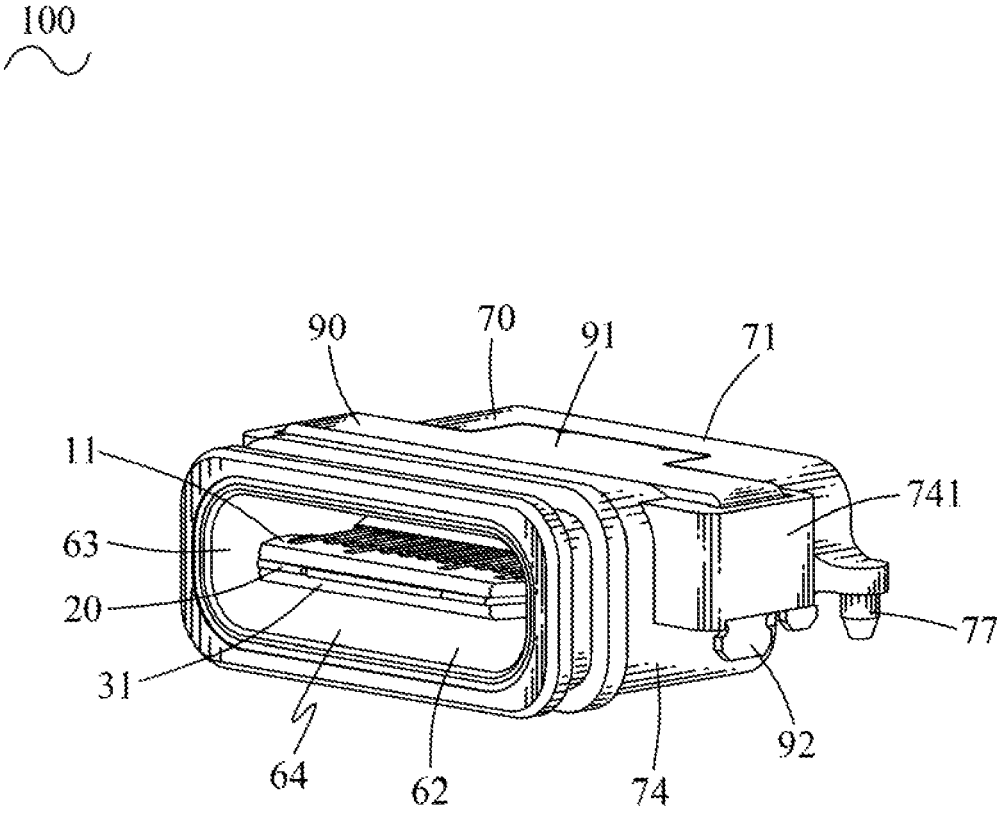
FIG. 1 is a perspective view of a waterproof connector in accordance with a first preferred embodiment of the present invention.

With reference to FIG. 1 to FIG. 15, a waterproof connector 100 in accordance with a preferred embodiment of the present invention is shown. The waterproof connector 100 includes an upper terminal module 10, a shielding plate 20, a lower terminal module 30, a dielectric element 40, a shielding element 50, a shielding shell 60, an insulating housing 70, a filling body 80 and a pinboard 90.

Figure 2:
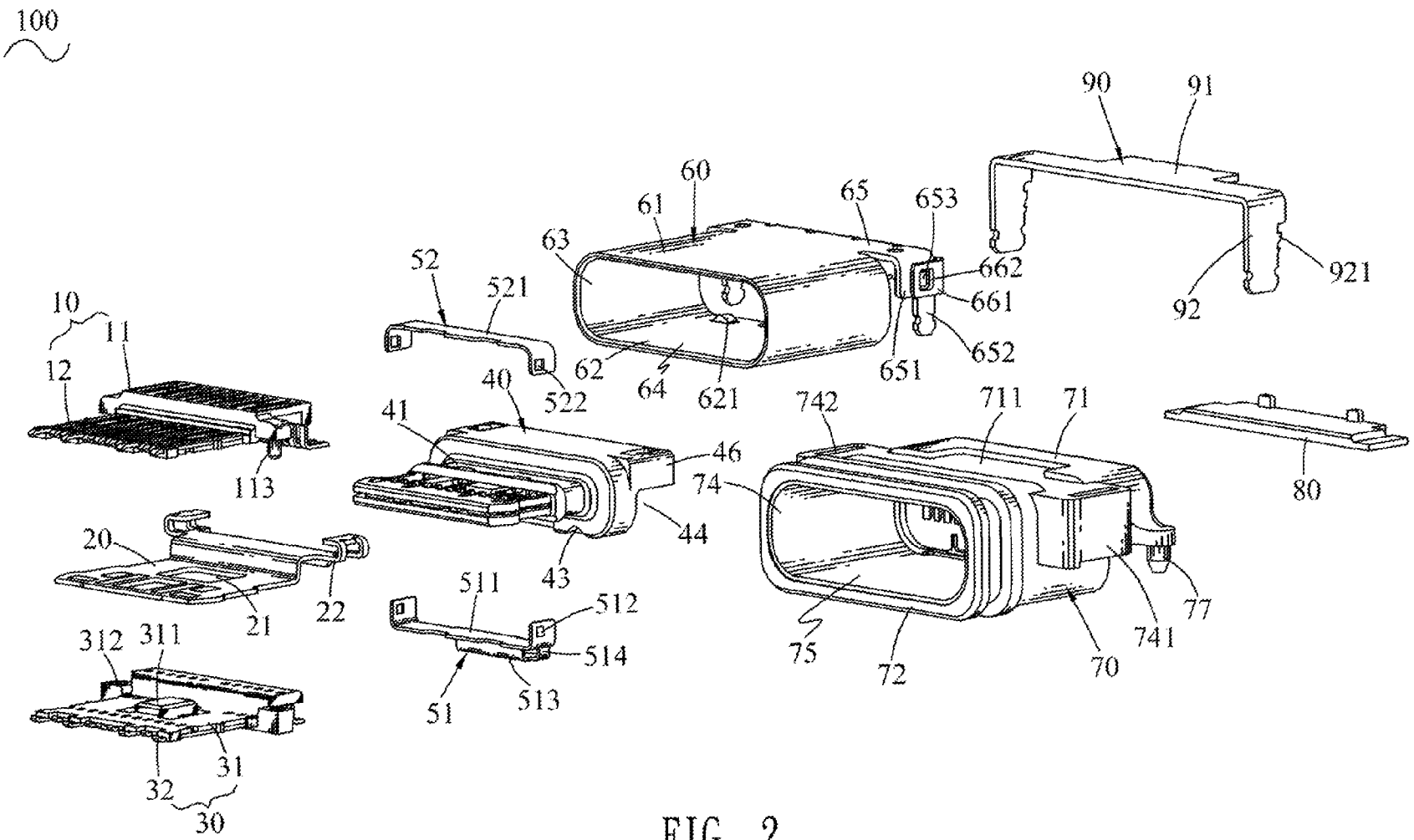
FIG. 2 is an exploded view of the waterproof connector of FIG. 1.
Figure 3:
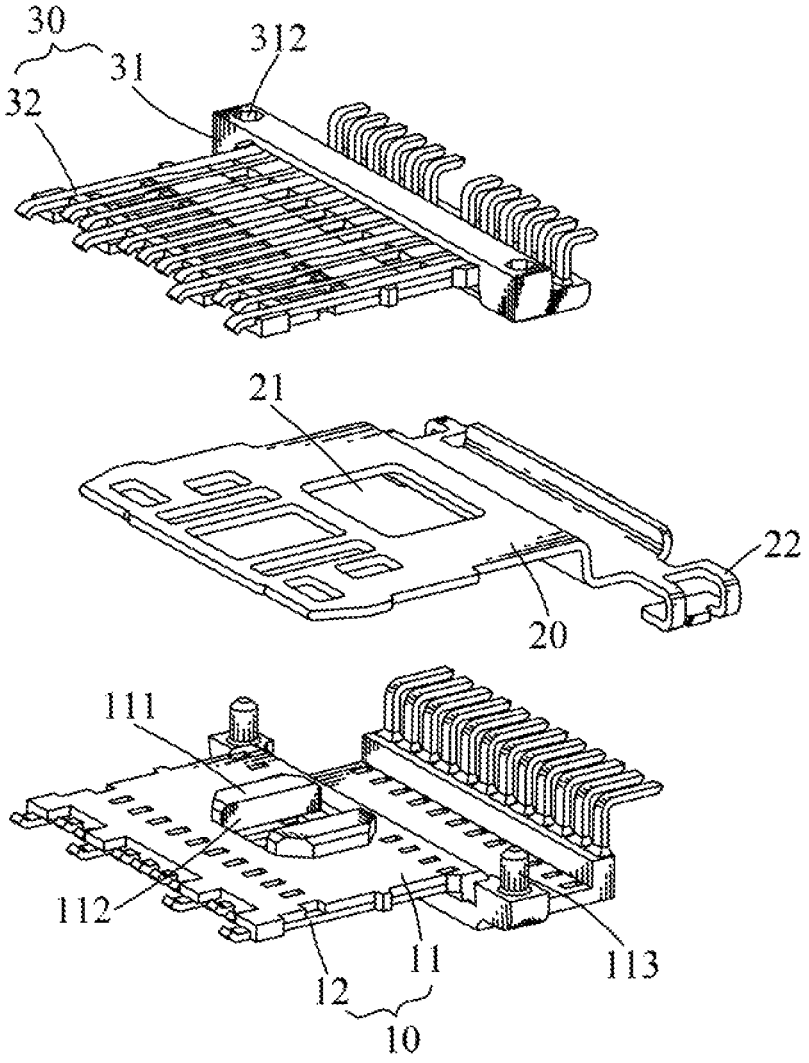
FIG. 3 is an exploded view showing an upper terminal module, a shielding plate and a lower terminal module of the waterproof connector of FIG. 1.

Referring to FIG. 2 and FIG. 3, the upper terminal module 10 includes an upper body 11 and a plurality of upper terminals 12. The upper body 11 is integrally molded outside the upper terminals 12. The upper terminals 12 are arranged transversely. Top surfaces of front ends of the upper terminals 12 are exposed to a top of the upper body 11 so as to electrically contact with a docking connector (not shown). Tail ends of the upper terminals 12 are exposed out of the upper body 11. A middle of a bottom surface of the upper body 11 protrudes downward to form a protruding block 111. A middle of the protruding block 111 is recessed inward to form a buckling groove 112. Two opposite sides of the bottom surface of the upper body 11 protrude downward to form two protruding pillars 113.

The shielding plate 20 is mounted under the upper terminal module 10. A middle of the shielding plate 20 opens an opening 21 corresponding to the protruding block 111 of the upper body 11. The protruding block 111 is locked in the opening 21. Two opposite sides of a rear end of the shielding plate 20 protrude outward to form two half-surrounded extending portions 22 with the mouths thereof facing each other. The two extending portions 22 of the shielding plate 20 project beyond two opposite sides of the upper body 11, respectively.

The lower terminal module 30 includes a lower body 31 and a plurality of lower terminals 32. The lower body 31 is integrally molded outside the lower terminals 32. The lower terminals 32 are arranged transversely. Bottom surfaces of front ends of the lower terminals 32 are exposed to a bottom of the lower body 31 so as to electrically contact with the docking connector. Tail ends of the lower terminals 32 are exposed out of the lower body 31. A middle of a top surface of the lower body 31 protrudes upward to form a buckling block 311 corresponding to the buckling groove 112 of the upper body 11. Two opposite sides of the lower body 31 define two insertion holes 312. The two insertion holes 312 are corresponding to the two protruding pillars 113, respectively.

Referring to FIG. 2, FIG. 3, FIG. 4 and FIG. 5, the lower terminal module 30 is mounted under the shielding plate 20. The buckling block 311 of the lower body 31 is buckled in the buckling groove 112 of the upper body 11. The protruding pillars 113 are inserted into the insertion holes 312, respectively. The two extending portions 22 of the shielding plate 20 project beyond two opposite sides of the lower body 31, respectively. So the shielding plate 20 is clamped between the upper body 11 of the upper terminal module 10 and the lower body 31 of the lower terminal module 30 by virtue of the upper body 11 of the upper terminal module 10 being buckled with the lower body 31 of the lower terminal module 30.

Figure 4:
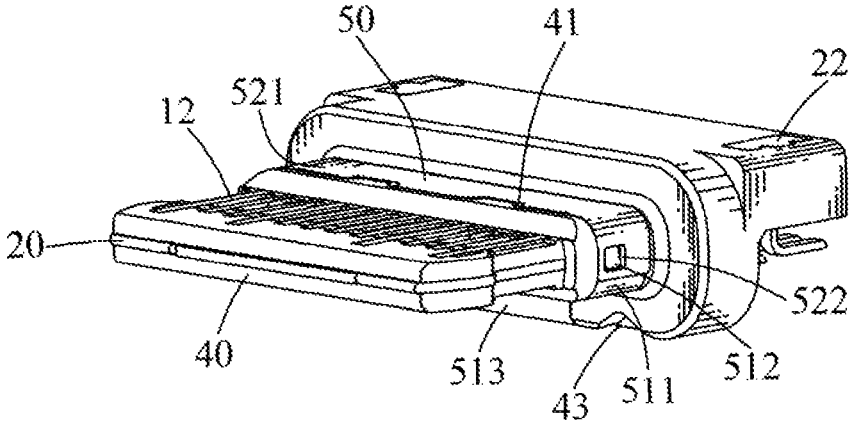
FIG. 4 is a perspective view showing the upper terminal module, the shielding plate, the lower terminal module, a dielectric element and a shielding element of the waterproof connector of FIG. 1.
Figure 5:
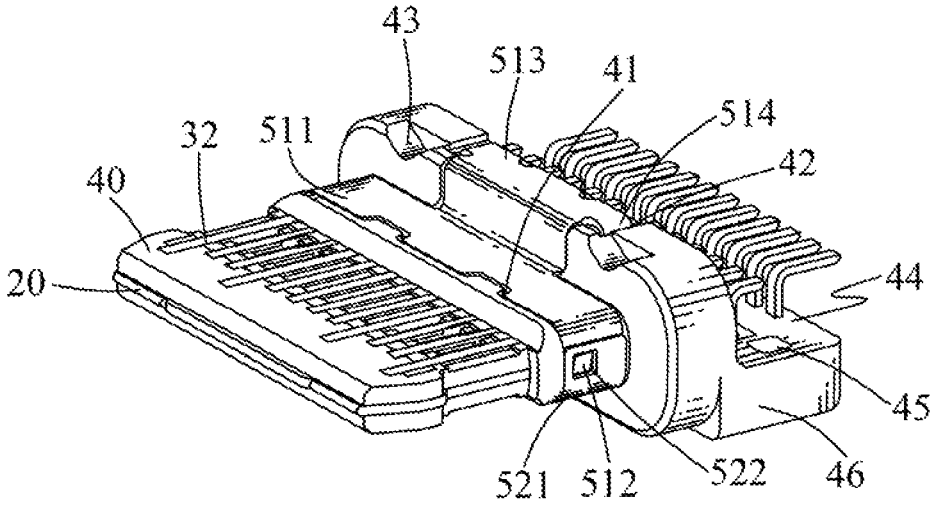
FIG. 5 is another perspective view showing the upper terminal module, the shielding plate, the lower terminal module, the dielectric element and the shielding element of the waterproof connector of FIG. 1.
Figure 6:
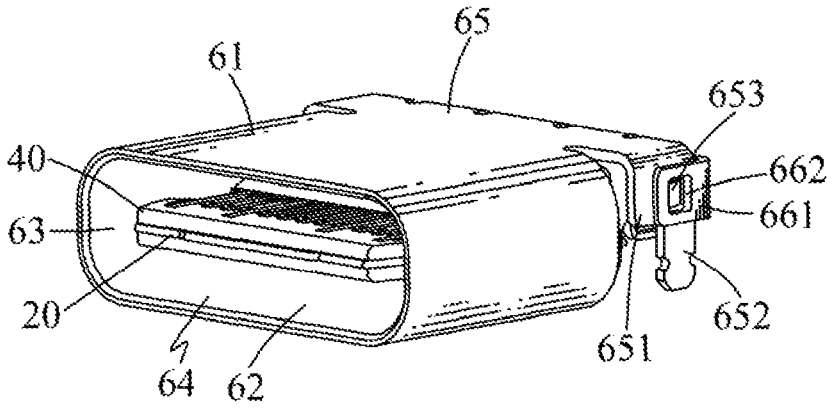
FIG. 6 is a partially perspective view of the waterproof connector of FIG. 1, wherein an insulating housing is omitted.
Figure 7:
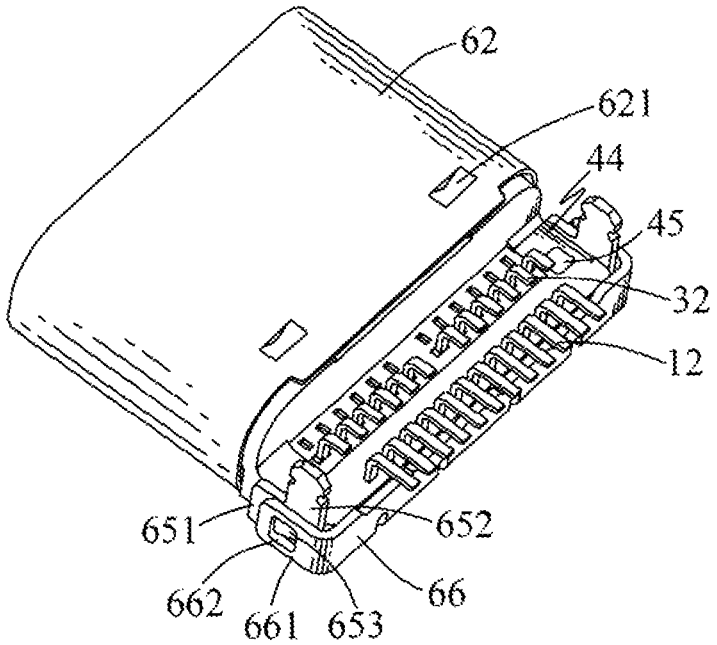
FIG. 7 is another partially perspective view of the waterproof connector of FIG. 1, wherein the insulating housing is omitted.
Figure 8:
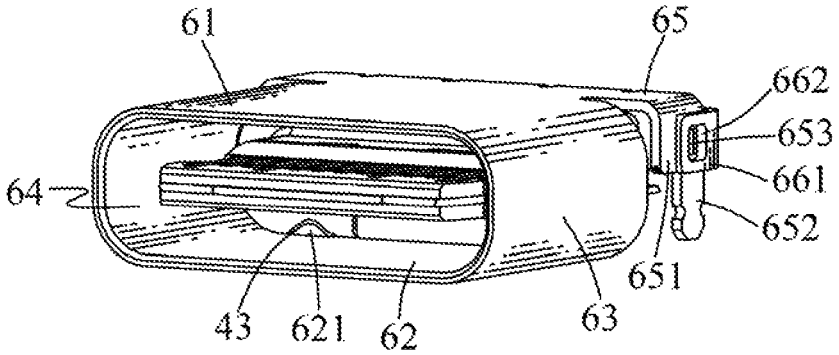
FIG. 8 is one more partially perspective view of the waterproof connector of FIG. 1, wherein the insulating housing is omitted.
Figure 9:
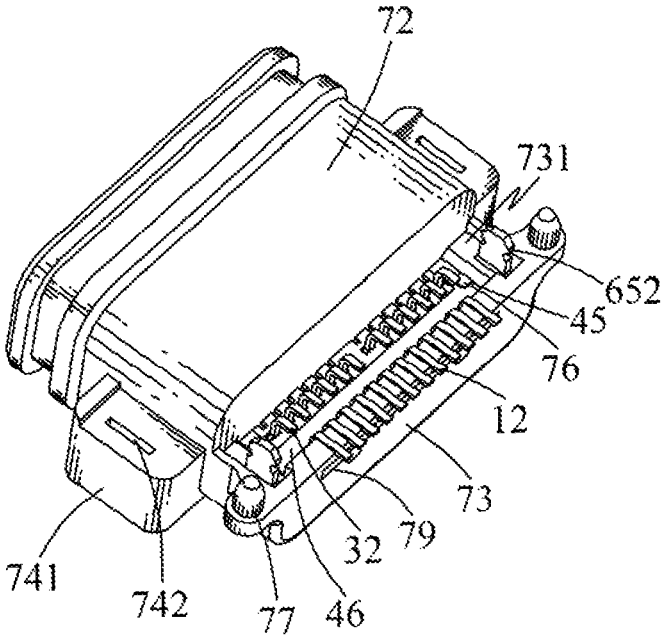
FIG. 9 is a perspective view of the waterproof connector of FIG. 1, wherein the insulating housing is located on an outside of the waterproof connector.

Referring to FIG. 2, FIG. 4 and FIG. 5, the dielectric element 40 is integrally molded outside the upper terminal module 10, the shielding plate 20 and the lower terminal module 30. A front end of the shielding plate 20 projects beyond a front surface of the dielectric element 40 so as to make the docking connector contact with the shielding plate 20 directly when the waterproof connector 100 is interconnected with the docking connector for effectively preventing the docking connector abutting against the front surface of the dielectric element 40 directly to result in a deformation of the waterproof connector 100.

Top surfaces of the extending portions 22 of the shielding plate 20 are exposed to a top surface of the dielectric element 40. A periphery of a substantial middle of the dielectric element 40 is recessed inward to form a ring-shaped assembling groove 41. Two opposite sides of a bottom surface of the dielectric element 40 are recessed inward to form two fastening holes 42 communicated with the assembling groove 41. The two opposite sides of the bottom surface of the dielectric element 40 are recessed inward to form two blocking grooves 43. The two fastening holes 42 are substantially located between the two blocking grooves 43. A rear end of the bottom surface of the dielectric element 40 is recessed inward to form a lacking groove 44. A top wall of the lacking groove 44 is defined as an extending board 46. The tail ends of the upper terminals 12 and the tail ends of the lower terminals 32 project beyond a bottom surface of the extending board 46. The tail ends of the upper terminals 12 and the tail ends of the lower terminals 32 are exposed out of the dielectric element 40 and are located in the lacking groove 44. Two opposite sides of a bottom of the top wall of the lacking groove 44 define two fastening grooves 45.

Referring to FIG. 2, FIG. 4 and FIG. 5, the shielding element 50 includes a lower shielding element 51 and an upper shielding element 52. The lower shielding element 51 has a substantially U-shaped lower assembling portion 511. Two opposite sides of the lower assembling portion 511 are punched outward to form two buckling pieces 512, respectively. A rear end of the lower assembling portion 511 is bent downward and then bent rearward to form a connecting portion 513. Two opposite sides of a rear end of the connecting portion 513 is bent upward to form two fastening portions 514. The upper shielding element 52 has a substantially n-shaped upper assembling portion 521. Two opposite sides of the upper assembling portion 521 open two buckling holes 522, respectively. The lower assembling portion 511 with the buckling pieces 512 is assembled in a lower portion of the assembling groove 41. The connecting portion 513 is disposed to a lower portion of a rear end of the dielectric element 40. The two fastening portions 514 are fastened in the two fastening holes 42. The upper assembling portion 521 is assembled in an upper portion of the assembling groove 41. The two buckling pieces 512 are buckled in the two buckling holes 522. The two opposite sides of the upper assembling portion 521 are fastened to the two opposite sides of the lower assembling portion 511 by a spot soldering way.

Referring to FIG. 2, FIG. 4, FIG. 6, FIG. 7 and FIG. 8, the shielding shell 60 surrounds the dielectric element 40 together with the upper terminal module 10, the shielding plate 20, the lower terminal module 30 and the shielding element 50. The shielding shell 60 has a top plate 61, a bottom plate 62 and two lateral plates 63. An insertion space 64 is formed among the top plate 61, the bottom plate 62 and the two lateral plates 63. The dielectric element 40 together with the upper terminal module 10, the shielding plate 20, the lower terminal module 30 and the shielding element 50 is inserted into the insertion space 64 of the shielding shell 60. Two sides of the bottom plate 62 of the shielding shell 60 are punched upward to form two blocking portions 621 corresponding to the two blocking grooves 43, respectively. The two blocking portions 621 are blocked in the two blocking grooves 43, respectively for preventing the dielectric element 40 from moving frontward to fall off from the shielding shell 60.

The bottom plate 62 of the shielding shell 60 contacts the lower shielding element 51. The bottom plate 62 of the shielding shell 60 is fastened to the lower shielding element 51 by the spot soldering way. A rear end of the top plate 61 extends rearward and then extends oppositely to form a connecting plate 65. Two opposite sides of the connecting plate 65 are bent downward to form two clamping plates 651. Bottom edges of the two clamping plates 651 extend downward to form two insertion feet 652. The two clamping plates 651 are punched outward to form two restricting blocks 653, respectively.

The connecting plate 65 is covered on the top surface of the dielectric element 40 and the two clamping plates 651 are attached to two side surfaces of the dielectric element 40. The connecting plate 65 of the shielding shell 60 contacts the extending portions 22 of the shielding plate 20. The connecting plate 65 of the shielding shell 60 is fastened to the extending portions 22 by the spot soldering way. A rear end of the connecting plate 65 is bent downward to form a rear plate 66. Two opposite sides of the rear plate 66 are bent frontward to form two restricting pieces 661. The two restricting pieces 661 of the shielding shell 60 open two restricting holes 662, respectively. The rear plate 66 of the shielding shell 60 is attached to a rear surface of the dielectric element 40. The two restricting pieces 661 are fastened to outer surfaces of the two clamping plates 651, respectively. The two restricting blocks 653 are restricted in the two restricting holes 662, respectively.

Referring to FIG. 1, FIG. 2, FIG. 4, FIG. 9, FIG. 11, FIG. 12, FIG. 13, FIG. 14 and FIG. 15, the insulating housing 70 is integrally molded outside the shielding shell 60 together with the upper terminal module 10, the shielding plate 20, the lower terminal module 30 and the dielectric element 40. The insulating housing 70 has a top board 71, a bottom board 72, a rear board 73 and two side boards 74. An accommodating space 75 is formed among the top board 71, the bottom board 72, the rear board 73 and the two side boards 74. The upper terminal module 10, the shielding plate 20, the lower terminal module 30, the dielectric element 40, the shielding element 50 and the shielding shell 60 are accommodated in the accommodating space 75. A rear end of a bottom of the insulating housing 70 is recessed inward to form a receiving space 731. A bottom surface of the rear board 73 is recessed inward to form the receiving space 731. The extending board 46, the tail ends of the upper terminals 12 of the upper terminal module 10, the tail ends of the lower terminals 32 of the lower terminal module 30 and the insertion feet 652 of the shielding shell 60 are received in the receiving space 731.

At least one portion of a rear surface of the rear board 73 is recessed inward to form at least one fastening hole 78 extending forward to the rear plate 66 of the shielding shell 60. At least one supporting pin (not shown) is disposed to the waterproof connector 100 so as to prevent a malposition among the insulating housing 70, the upper terminal module 10, the shielding plate 20, the lower terminal module 30, the dielectric element 40 and the shielding shell 60 being occurred. After the insulating housing 70 is integrally molded, the at least one supporting pin is removed from the waterproof connector 100 to form the at least one fastening hole 78. The rear board 73 opens a rectangular guiding hole 79 penetrating rearward through the rear surface of the rear board 73 and extending forward to the receiving space 731. The guiding hole 79 is communicated with the receiving space 731 and the at least one fastening hole 78. At least one portion of a bottom surface of a top wall of the guiding hole 79 is recessed inward to form the at least one fastening hole 78 penetrating through a rear surface of the top wall of the guiding hole 79. The bottom surface of the extending board 46 is flush with the bottom surface of the top wall of the guiding hole 79. A space occupied by the tail ends of the upper terminals 12 and a space occupied by the tail ends of the lower terminals 32 are located between two facing surfaces of two side walls of the guiding hole 79.

Outer peripheries of two portions of a top wall of the receiving space 731 respectively molded around the two insertion feet 652 are chamfered to facilitate the insertion feet 652 for realizing a limiting action. A junction between a bottom surface and an inner surface of each side wall of the receiving space 731 connected with the lower body 31 of the lower terminal module 30 is chamfered for guiding molten plastics flowing towards the lower terminal module 30. The inner surfaces of the two side walls of the receiving space 731 form two fastening pillars 76 corresponding to the two fastening grooves 45, respectively. The two fastening pillars 76 are fastened in the two fastening grooves 45, respectively. A top surface of the top board 71 of the insulating housing 70 is recessed inward to form a locating groove 711. Two opposite sides of a front end of the locating groove 711 extend outward and beyond two opposite sides of a rear end of the locating groove 711, respectively. The two side boards 74 of the insulating housing 70 protrude outward to form two locating blocks 741, respectively. Each of the locating blocks 741 opens a locating hole 742 extending vertically.

Referring to FIG. 2, FIG. 10, FIG. 12, FIG. 13, FIG. 14 and FIG. 15, the filling body 80 is a waterproof adhesive. The filling body 80 is filled in the receiving space 731, the guiding hole 79 and the at least one fastening hole 78 of the insulating housing 70, and the filling body 80 flows from the receiving space 731 to the guiding hole 79 and the at least one fastening hole 78, so that the filling body 80 is capable of completely sealing up an interstice between upper portions of each two adjacent tail ends of the upper terminals 12 and the lower terminals 32, and joints among the extending board 46, the insulating housing 70, the upper terminal module 10, the shielding plate 20, the lower terminal module 30 and the shielding shell 60. The two insertion feet 652 of the shielding shell 60, the tail ends of the upper terminals 12 of the upper terminal module 10 and the tail ends of the lower terminals 32 of the lower terminal module 30 are exposed out of the filling body 80.

Figure 10:
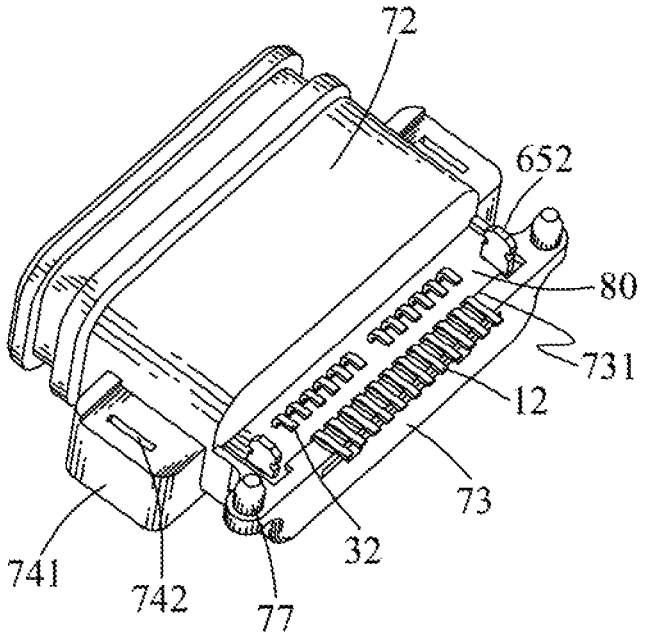
FIG. 10 is a perspective view of the waterproof connector of FIG. 1, wherein a filling body is filled into the waterproof connector.
Figure 11:
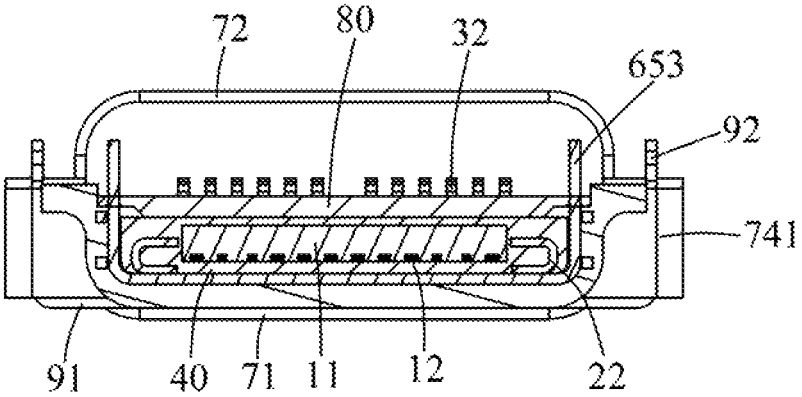
FIG. 11 is a sectional view of the waterproof connector of FIG. 1.
Figure 12:
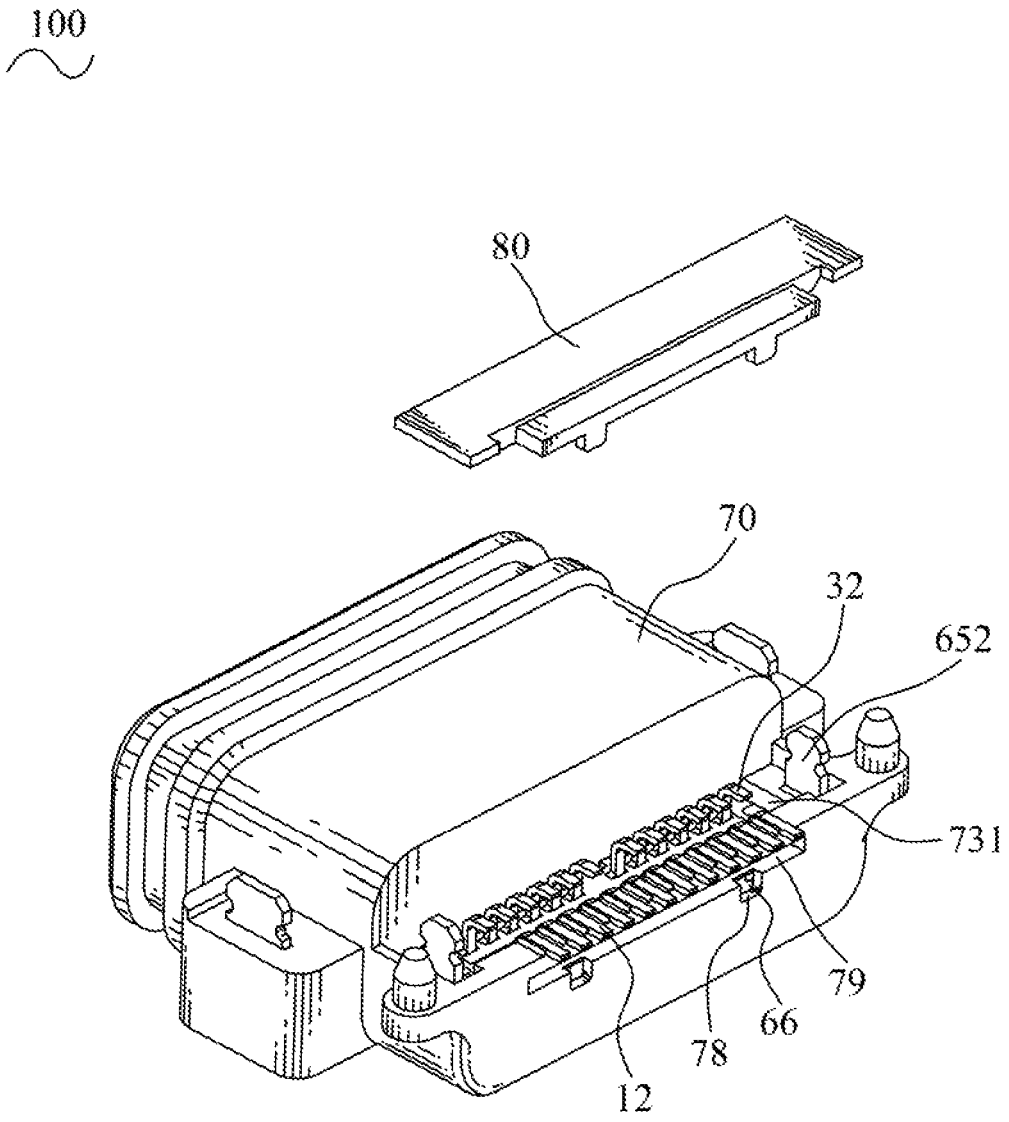
FIG. 12 is another exploded view of the waterproof connector of FIG. 1.
Figure 13:
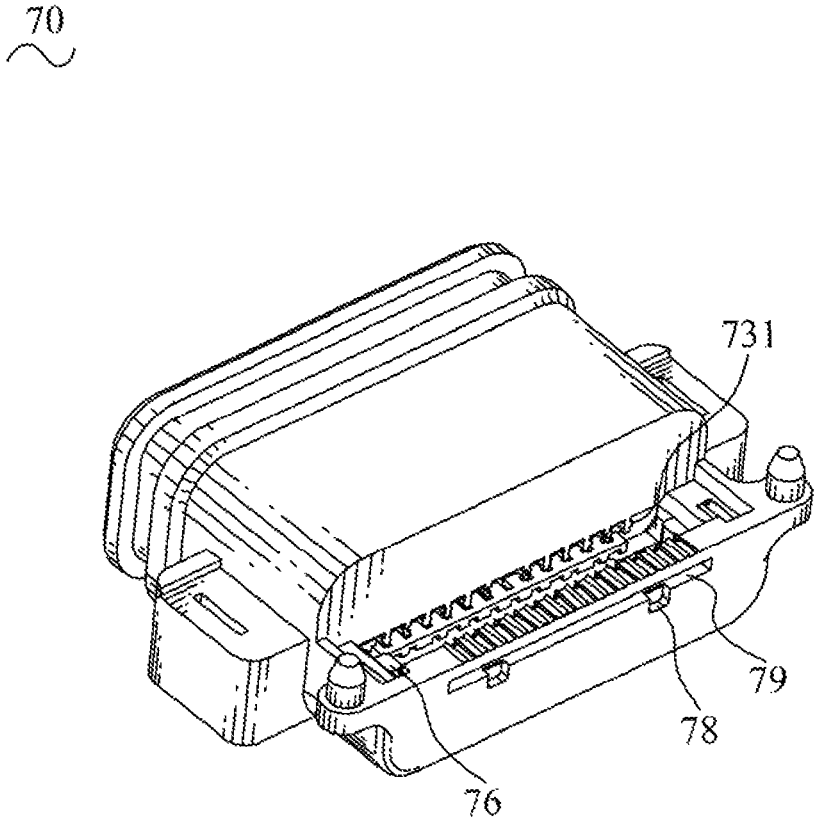
FIG. 13 is a perspective view of the insulating housing of the waterproof connector of FIG. 1.
Figure 14:
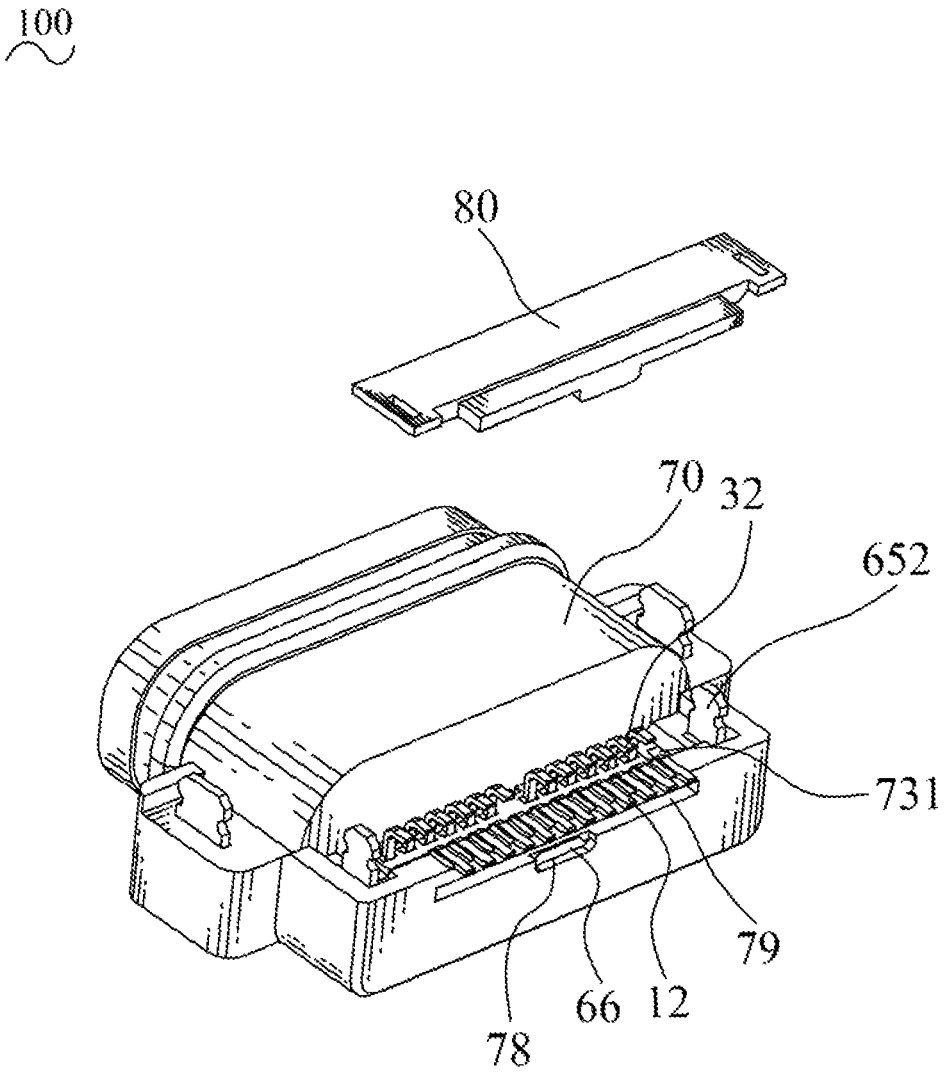
FIG. 14 is an exploded view of a waterproof connector in accordance with a second preferred embodiment of the present invention.
Figure 15:
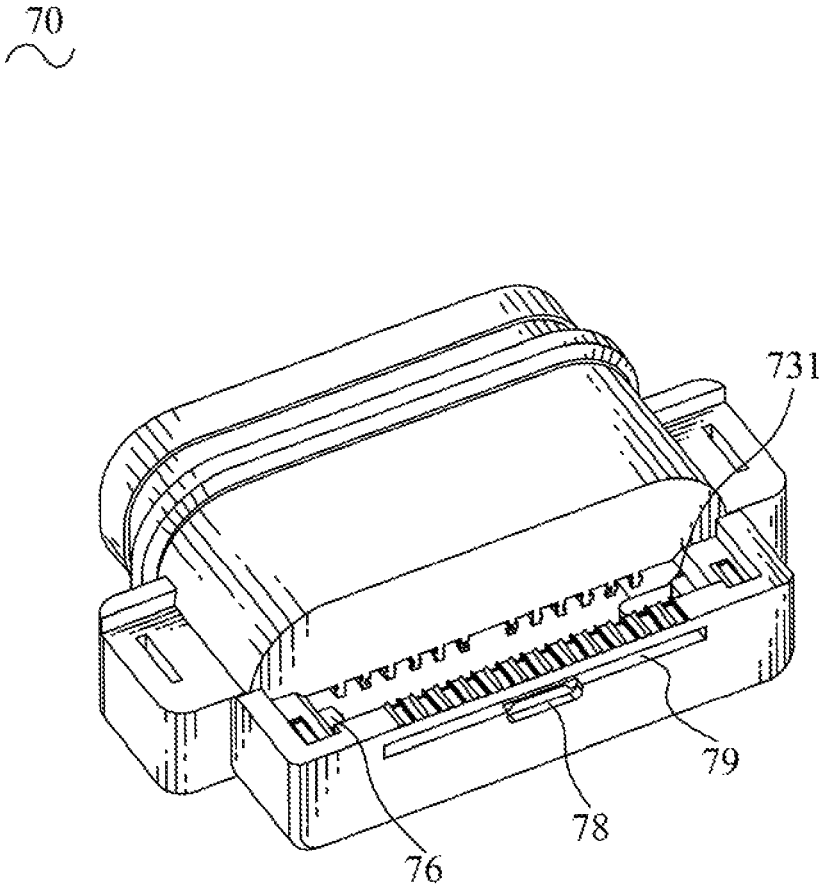
FIG. 15 is a perspective view of an insulating housing of the waterproof connector of FIG. 14.

Referring to FIG. 1, FIG. 2 and FIG. 10, the pinboard 90 has a locating board 91. Two opposite sides of a front end of the locating board 91 extend outward and beyond two opposite sides of a rear end of the locating board 91 for increasing an adsorption area to make a suction nozzle adsorb the waterproof connector 100 more stably. Two opposite sides of the locating board 91 are bent downward to form two locating feet 92. Several portions of a rear edge of each of the locating feet 92 protrude rearward to form a plurality of barbs 921. The locating board 91 is located in the locating groove 711 of the insulating housing 70. The two locating feet 92 are inserted into the two locating holes 742 of the two locating blocks 741. The barbs 921 of the two locating feet 92 interfere with inner walls of the two locating holes 742, respectively, for preventing the pinboard 90 breaking upward away from the insulating housing 70.

Referring to FIG. 1 to FIG. 15, the waterproof connector 100 in accordance with the preferred embodiment of the present invention is a waterproof connector 100 in accordance with a first preferred embodiment of the present invention or a waterproof connector 100 in accordance with a second preferred embodiment of the present invention.

The waterproof connector 100 in accordance with the first preferred embodiment of the present invention is shown. In the first preferred embodiment, two opposite sides of the rear surface of the rear board 73 are recessed inward to form two fastening holes 78 extending forward to the rear plate 66 of the shielding shell 60. Two supporting pins (not shown) are disposed to the waterproof connector 100 so as to prevent the malposition among the insulating housing 70, the upper terminal module 10, the shielding plate 20, the lower terminal module 30, the dielectric element 40 and the shielding shell 60 being occurred. After the insulating housing 70 is integrally molded, the two supporting pins are removed from the waterproof connector 100 to form the two fastening holes 78. The guiding hole 79 is communicated with the receiving space 731 and the two fastening holes 78. Two opposite sides of the bottom surface of the top wall of the guiding hole 79 are recessed inward to form the two fastening holes 78 penetrating through the rear surface of the top wall of the guiding hole 79. The filling body 80 is filled in the receiving space 731, the guiding hole 79 and the two fastening holes 78 of the insulating housing 70, and the filling body 80 flows from the receiving space 731 to the guiding hole 79 and the two fastening holes 78, so that the filling body 80 is capable of completely sealing up the interstice between the upper portions of each two adjacent tail ends of the upper terminals 12 and the lower terminals 32, and the joints among the extending board 46, the insulating housing 70, the upper terminal module 10, the shielding plate 20, the lower terminal module 30 and the shielding shell 60. Two opposite sides of a bottom of the top board 71 of the insulating housing 70 protrude downward to form two insertion pillars 77 located adjacent to and spaced from outer sides of the two insertion feet 652.

The waterproof connector 100 in accordance with the second preferred embodiment of the present invention is shown. In the second preferred embodiment, a middle of the rear surface of the rear board 73 is recessed inward to form a fastening hole 78 extending forward to the rear plate 66 of the shielding shell 60. A supporting pin (not shown) is disposed to the waterproof connector 100 so as to prevent the malposition among the insulating housing 70, the upper terminal module 10, the shielding plate 20, the lower terminal module 30, the dielectric element 40 and the shielding shell 60 being occurred. After the insulating housing 70 is integrally molded, the supporting pin is removed from the waterproof connector 100 to form the fastening hole 78. The guiding hole 79 is communicated with the receiving space 731 and the fastening hole 78. A middle of the bottom surface of the top wall of the guiding hole 79 is recessed inward to form the fastening hole 78 penetrating through the rear surface of the top wall of the guiding hole 79. The filling body 80 is filled in the receiving space 731, the guiding hole 79 and the fastening hole 78 of the insulating housing 70, and the filling body 80 flows from the receiving space 731 to the guiding hole 79 and the fastening hole 78, so that the filling body 80 is capable of completely sealing up the interstice between the upper portions of each two adjacent tail ends of the upper terminals 12 and the lower terminals 32, and the joints among the extending board 46, the insulating housing 70, the upper terminal module 10, the shielding plate 20, the lower terminal module 30 and the shielding shell 60. Structures of the two opposite sides of the bottom of the top board 71 of the insulating housing 70 in accordance with the first preferred embodiment are different from structures of the two opposite sides of the bottom of the top board 71 of the insulating housing 70 in accordance with the second preferred embodiment. The two opposite sides of the bottom of the top board 71 of the insulating housing 70 are without the two insertion pillars 77.

As described above, the upper body 11 is integrally molded outside the upper terminals 12, the lower body 31 is integrally molded outside the lower terminals 32, the shielding plate 20 is clamped between the upper body 11 of the upper terminal module 10 and the lower body 31 of the lower terminal module 30 by virtue of the upper body 11 being buckled with the lower body 31, the dielectric element 40 is integrally molded outside the upper terminal module 10, the shielding plate 20 and the lower terminal module 30 to seal up a clearance among the upper terminal module 10, the lower terminal module 30 and the shielding plate 20, the shielding shell 60 surrounds the dielectric element 40 together with the upper terminal module 10, the shielding plate 20 and the lower terminal module 30, the insulating housing 70 is integrally molded outside the shielding shell 60 together with the upper terminal module 10, the shielding plate 20, the lower terminal module 30 and the dielectric element 40 to seal up a clearance among the shielding shell 60, the upper terminal module 10, the shielding plate 20, the lower terminal module 30 and the dielectric element 40, so that water hardly seeps into the waterproof connector 100 by virtue of the waterproof connector 100 adopting multiple integrative molding procedures to surround the upper terminals 12, the shielding plate 20, the lower terminals 32 and the shielding shell 60 therein. Furthermore, the filling body 80 is filled in the receiving space 731, the guiding hole 79 and the at least one fastening hole 78 of the insulating housing 70, and the filling body 80 flows from the receiving space 731 to the guiding hole 79 and the at least one fastening hole 78, so that the filling body 80 is capable of completely sealing up the interstice between the upper portions of each two adjacent tail ends of the upper terminals 12 and the lower terminals 32, and the joints among the extending board 46, the insulating housing 70, the upper terminal module 10, the shielding plate 20, the lower terminal module 30 and the shielding shell 60. As a result, the waterproof connector 100 has a better waterproof performance.

What is claimed is:

1. A waterproof connector, comprising:

an upper terminal module including an upper body and a plurality of upper terminals, the upper body being integrally molded outside the upper terminals, the upper terminals being arranged transversely, top surfaces of front ends of the upper terminals being exposed to a top of the upper body, tail ends of the upper terminals being exposed out of the upper body, a middle of a bottom surface of the upper body protruding downward to form a protruding block, a middle of the protruding block being recessed inward to form a buckling groove;

a shielding plate mounted under the upper terminal module, a middle of the shielding plate having an opening corresponding to the protruding block, the protruding block being locked in the opening;

a lower terminal module mounted under the shielding plate, including a lower body and a plurality of lower terminals, the lower body being integrally molded outside the lower terminals, the lower terminals being arranged transversely, bottom surfaces of front ends of the lower terminals being exposed to a bottom of the lower body, tail ends of the lower terminals being exposed out of the lower body, a middle of a top surface of the lower body protruding upward to form a buckling block corresponding to the buckling groove, the buckling block being buckled in the buckling groove;

a dielectric element integrally molded outside the upper terminal module, the shielding plate and the lower terminal module, a front end of the shielding plate projecting beyond a front surface of the dielectric element, a rear end of a bottom surface of the dielectric element being recessed inward to form a locking groove, a top wall of the locking groove being defined as an extending board, the tail ends of the upper terminals and the tail ends of the lower terminals projecting beyond a bottom surface of the extending board and being located in the locking groove;

a shielding shell surrounding the dielectric element together with the upper terminal module, the shielding plate and the lower terminal module;

an insulating housing integrally molded outside the shielding shell together with the upper terminal module, the shielding plate, the lower terminal module and the dielectric element, the insulating housing having a top board, a bottom board, a rear board and two side boards, an accommodating space being formed among the top board, the bottom board, the rear board and the two side boards, the upper terminal module, the shielding plate, the lower terminal module, the dielectric element and the shielding shell being accommodated in the accommodating space, a bottom surface of the rear board being recessed inward to form a receiving space, the extending board, the tail ends of the upper terminals and the tail ends of the lower terminals being received in the receiving space, the rear board opening a guiding hole penetrating rearward through a rear surface of the rear board and extending forward to the receiving space, the guiding hole being communicated with the receiving space, the bottom surface of the extending board being flush with a bottom surface of a top wall of the guiding hole, a space occupied by the tail ends of the upper terminals and a space occupied by the tail ends of the lower terminals being located between two facing surfaces of two side walls of the guiding hole; and a filling body filled in the receiving space and the guiding hole of the insulating housing, the tail ends of the upper terminals and the tail ends of the lower terminals being exposed out of the filling body.

2. The waterproof connector as claimed in claim 1, wherein the filling body is a waterproof adhesive.

3. The waterproof connector as claimed in claim 1, wherein at least one portion of the rear surface of the rear board is recessed inward to form at least one fastening hole extending forward to a rear plate of the shielding shell, the guiding hole is communicated with the at least one fastening hole.

4. The waterproof connector as claimed in claim 3, wherein at least one portion of the bottom surface of the top wall of the guiding hole is recessed inward to form the at least one fastening hole penetrating through a rear surface of the top wall of the guiding hole, the guiding hole is communicated with the at least one fastening hole.

5. The waterproof connector as claimed in claim 3, wherein the filling body is filled in the at least one fastening hole, and the filling body flows from the receiving space to the guiding hole and the at least one fastening hole, so that the filling body is capable of completely sealing up an interstice between upper portions of each two adjacent tail ends of the upper terminals and the lower terminals, and joints among the extending board, the insulating housing, the upper terminal module, the shielding plate, the lower terminal module and the shielding shell.

6. The waterproof connector as claimed in claim 1, wherein two opposite sides of the rear surface of the rear board are recessed inward to form two fastening holes extending forward to a rear plate of the shielding shell, the guiding hole is communicated with the two fastening holes.

7. The waterproof connector as claimed in claim 6, wherein two opposite sides of the bottom surface of the top wall of the guiding hole are recessed inward to form the two fastening holes penetrating through a rear surface of the top wall of the guiding hole, the guiding hole is communicated with the two fastening holes.

8. The waterproof connector as claimed in claim 6, wherein the filling body is filled in the two fastening holes, and the filling body flows from the receiving space to the guiding hole and the two fastening holes, so that the filling body is capable of completely sealing up an interstice between upper portions of each two adjacent tail ends of the upper terminals and the lower terminals, and joints among the extending board, the insulating housing, the upper terminal module, the shielding plate, the lower terminal module and the shielding shell.

9. The waterproof connector as claimed in claim 1, wherein a middle of the rear surface of the rear board is recessed inward to form a fastening hole extending forward to a rear plate of the shielding shell, the guiding hole is communicated with the fastening hole.

10. The waterproof connector as claimed in claim 9, wherein a middle of the bottom surface of the top wall of the guiding hole is recessed inward to form the fastening hole penetrating through a rear surface of the top wall of the guiding hole, the guiding hole is communicated with the fastening hole.

11. The waterproof connector as claimed in claim 9, wherein the filling body is filled in the fastening hole of the insulating housing, and the filling body flows from the receiving space to the guiding hole and the fastening hole, so that the filling body is capable of completely sealing up an interstice between upper portions of each two adjacent tail ends of the upper terminals and the lower terminals, and joints among the extending board, the insulating housing, the upper terminal module, the shielding plate, the lower terminal module and the shielding shell.

* * * * *